US007063066B2

(12) United States Patent
Wind

(10) Patent No.: US 7,063,066 B2
(45) Date of Patent: Jun. 20, 2006

(54) METHOD AND APPARATUS FOR ADAPTIVELY CONTROLLING A DEVICE TO A POSITION

(75) Inventor: Robert Harold Wind, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 237 days.

(21) Appl. No.: 10/443,284

(22) Filed: May 22, 2003

(65) Prior Publication Data

US 2004/0231641 A1 Nov. 25, 2004

(51) Int. Cl.
*F02D 41/14* (2006.01)
*F02D 11/10* (2006.01)

(52) U.S. Cl. ..... 123/399

(58) Field of Classification Search ..... 123/361, 123/399, 352, 339.21; 701/102; 180/179
See application file for complete search history.

(56) References Cited

U.S. PATENT DOCUMENTS 4,964,051 A * 10/1990 Sekozawa et al. ..... 701/102
5,406,920 A * 4/1995 Murata et al. ..... 123/399
5,666,917 A * 9/1997 Fraser et al. ..... 123/339.11
5,749,343 A 5/1998 Nichols et al.
5,852,996 A * 12/1998 Nakamura et al. ..... 123/399
6,055,960 A 5/2000 Marumoto et al.
6,157,888 A * 12/2000 Suzio et al. ..... 123/399
6,311,679 B1 * 11/2001 Druzhinina et al. ... 123/568.21
6,363,316 B1 * 3/2002 Soliman et al. ..... 701/104
6,367,271 B1 4/2002 Forrest et al.
6,378,493 B1 4/2002 Pursifull et al.
6,437,456 B1 8/2002 Kimura et al.
6,510,839 B1 * 1/2003 Pursifull ..... 123/399
6,522,038 B1 2/2003 Byram
6,523,522 B1 * 2/2003 Costin ..... 123/399
6,564,774 B1 * 5/2003 Ellims et al. ..... 123/352
2003/0023365 A1 1/2003 Yang et al.

* cited by examiner

*Primary Examiner*—T. M. Argenbright
(74) *Attorney, Agent, or Firm*—Jimmy L. Funke

(57) ABSTRACT

A control system and method for controlling position of a device by replacing the combination of a feedforward term, a calibrated step, and an integration term in a control scheme with an adaptive feedforward term. An embodiment is provided including a flow control valve on an internal combustion engine. The invention includes characterizing the flow control valve, and determining an error term, based upon monitored position and commanded input to the flow control valve. The adaptive feedforward term is determined based upon the monitored position, the characterization of the flow control valve, and the error term. The flow control valve is controlled to a position, based upon the adaptive feedforward term and the error term. When an absolute value of a derivative term, i.e. a time-rate change of the monitored position, is less than a preset value, the control system updates the characterization of the flow control valve.

8 Claims, 5 Drawing Sheets

METHOD AND APPARATUS FOR ADAPTIVELY CONTROLLING A DEVICE TO A POSITION

TECHNICAL FIELD

This invention pertains generally to control systems, and more specifically to an adaptive control system for controlling a device to a position, including controlling a flow control valve, such as an air management valve that is used in an internal combustion engine.

BACKGROUND OF THE INVENTION

A designer incorporates a control system to control position of a device, for example a flow control valve that manages air intake on an internal combustion engine. A typical control system comprises the device, e.g. the flow control valve, with an electromechanical actuator and a position sensor, a controller, and a commanded input from an external input signal. The controller controls applied force to the electromagnetic actuator, based upon the commanded input and feedback from the position sensor, to control position of the device. Performance parameters for such systems typically include a measure of the ability of the device to respond to the input command in terms of response time and settling, and an ability of the device to maintain a stable position.

When the device is the flow control valve, the applied force necessary to achieve and maintain a specific position of the flow control valve is variable depending upon the position of the valve. When the flow control valve is the air management valve, the applied force typically comprises the force necessary to overcome load force on the electromagnetic actuator, including for example, bearing friction and return-spring force, and an air load force from flow of air around the valve. When the air management valve comprises an electronic throttle control device on an internal combustion engine, load forces typically include bearing friction, return-spring force, and an air load force resulting from engine pumping. The applied force necessary to achieve and maintain the specific position of the flow control valve may also be affected by its direction of rotation. Each of the aforementioned load forces is further affected by component manufacturing tolerances and interferences, ambient conditions, and component wear and cleanliness.

The control system is typically executed as algorithms and calibrations in the controller. Control system designers employ traditional control strategies, including proportional, integral, and derivative terms, to achieve acceptable control over position of the device. The designers employ a steady-state position error in a simple proportional (P) or proportional-plus-derivative (PD) control algorithm to counteract load forces on the flow control valve. When the load force is a predictable function of flow control valve position, a feedforward term may be added to the P or PD control algorithm to provide the applied force, in terms of an actuator energization signal, necessary to counteract the load force. A predictable load force caused by friction is compensated by a calibrated step change in the actuator energization signal and is dependent upon the direction of actuator movement. When the load force varies as a predictable function of flow control valve position, the calibrated step change can vary accordingly. However, the predictability of the applied force required to move the actuator to a desired position is generally limited, due to unpredictable changes in the load force. Changes in the load force include variations in ambient conditions, variations in component design, manufacturing, application, and customer usage, variations in system operating conditions, and others. The aforementioned variations in the load force lead to inaccuracies in a control system that employs a fixed-calibration feedforward term or step change.

Designers may add an integrator with an integral term (I) to the control algorithm to compensate for control system inaccuracies that lead to limited ability to predict the applied force necessary to achieve a specific actuator position. The integrator output changes at a rate that is proportional to the position error, i.e. a difference between monitored position and commanded input to the actuator. The integrator accumulates an offset to the actuator energization signal until the position error is zero. The accumulated integrator output signal required to compensate for changes in load force typically varies with actuator position and direction of movement, thus requiring the integrator to adjust output accordingly when a change in actuator position is commanded.

The integrator may be designed to rapidly adjust to a new steady-state value to improve response of the flow control valve. Rapid adjustment causes the integrator term to quickly accumulate (wind-up) an erroneous value when the position error term is temporarily large. This typically occurs during a sudden, large change in the external input signal. A control system for a flow control valve employing a rapidly adjusting integrator term may be underdamped, leading to unwanted oscillations in the position of the flow control valve actuator, and corresponding system instability.

The integrator may instead be designed to slowly adjust to a new steady-state value, for more accurate response of the flow control valve. Slow adjustment of the integrator term causes the integrator term to adjust slowly to changes in the external input signal, even when the position error term is large. A control system for a flow control valve employing a slowly adjusting integrator term may be overdamped, leading to slow response of the flow control valve to a new position. This may lead to operator dissatisfaction.

Therefore, what is needed is a control system and method for position control of a flow control valve with an electromechanical actuator, such as an air management valve. The preferred control system and method responds rapidly and accurately to the external input signal and adaptively adjusts to changes in the various applied forces on the actuator, including forces applied by the components, external forces, and forces affected by direction of movement of the actuator.

SUMMARY OF THE INVENTION

The present invention provides an improvement over a typical control system and method for controlling position of a device, such as a flow control valve, by replacing the combination of a feedforward term, a calibrated step, and an integration term with an adaptive feedforward term. The invention includes a method and control system for characterizing the flow control valve, and determining an error term, based upon monitored position and commanded input to the flow control valve. The adaptive feedforward term is determined based upon the monitored position, the characterization of the flow control valve, and the error term. The flow control valve is controlled to a position, based upon the adaptive feedforward term and the error term. A derivative term is also determined, based upon the time-rate change of the monitored position. When the absolute value of the derivative term is less than a preset value, the control system updates the characterization of the flow control valve, which is represented by integration terms in the adaptive feedforward term.

The adaptive feedforward term of the present invention comprises an energization signal sent to the actuator that is necessary to achieve the desired position of the air control valve. There is a plurality of energization signal values, wherein each energization signal value corresponds to a discrete value, or breakpoint, over a range of monitored positions for the air control valve. The monitored positions are typically determined using a position sensor. Between adjacent breakpoints, there is a straight-line approximation of energization signal versus the monitored position. For a flow control valve with negligible friction, a single plurality of energization signals and straight-line approximations corresponding to monitored position of the flow control valve is created to compensate for variation in the load. For a flow control valve with measurable friction, first and second pluralities of energization signals and straight-line approximations corresponding to monitored position of the flow control valve is created to compensate for variation in the load. The first and second pluralities of energization signals and straight-line approximations are determined based upon whether the flow control valve is opening or closing.

The plurality of energization signal values are implemented as a plurality of integrators with corresponding integration terms, wherein initial integration terms are determined based upon the initial characterization of the flow control valve.

When the monitored position is at one of the breakpoints, the adaptive feedforward term is determined by integrating the error term using the integrator corresponding to the breakpoint, and providing the integrated output as the adaptive feedforward term to determine the energization signal. When the monitored position is between two breakpoints, the adaptive feedforward term is determined by interpolating between the integrators corresponding to the two breakpoints. To determine the adaptive feedforward term when the monitored position is between breakpoints, the error term is scaled in proportion to the monitored position of the actuator between the breakpoints to create a first input and a second input. The first input is applied to one of the of the two integrators corresponding to the two breakpoints, and the second input is applied to the second of the two integrators. The outputs of each of the two integrators are then interpolated to determine the adaptive feedforward term. Thus, if the actuator is positioned a third of the distance between a first breakpoint with first integrator and a second breakpoint to with second integrator, then two thirds of the error term is input to the first integrator and a third of the error term is input to the second integrator. Similarly, the outputs of the integrators are interpolated such that two thirds of the output from the first integrator is added to one third of the output from the second integrator to determine the adaptive feedforward value. Integrators not adjacent to the segment corresponding to the monitored position receive a zero input, and hence do not contribute to the adaptive feedforward term.

When the flow control valve has negligible friction (i.e. resistance to movement), the adaptive feedforward term is determined using a single plurality of integrators and corresponding integration terms at each breakpoint to adapt for variations in load on the flow control valve. There are a series of straight-line approximations for integration terms between each set of breakpoints. When the flow control valve has measurable friction, the adaptive feedforward term is determined using a first and a second plurality of integrators with corresponding first and second pluralities of integration terms at each breakpoint. The first and second pluralities of integrators with first and second pluralities of integration terms at each breakpoint adapt for variations in load on the flow control valve, and are also dependent upon whether the air flow control valve is opening or closing. The first plurality of integrators and integration factors comprise a series of breakpoints and straight lines approximating the energization signal versus monitored position when the flow control valve is opening. The second plurality of integrators and integration factors comprise a series of breakpoints and straight lines approximating the energization signal versus monitored position when the flow control valve is closing (See FIG. 2D).

When the derivative term is less than a preset value, the control system updates the integration terms in the adaptive feedforward term for the monitored position. The control system stores and subsequently applies the updated integration terms for the monitored position. The control system, using the adaptive feedforward term, integrators and breakpoints, effectively learns and compensates for non-linear load force based upon monitored position. The result is reduced system instability (i.e. wind-up and settling time) compared to conventional control systems with feedforward control and integrators.

The integration terms of the adaptive feedforward term respond more slowly than a typical integrator, because the system only selectively updates integration terms. The adaptive feedforward term only updates integration terms when the specific integrators are used by the control system. When the actuator returns to a position, the specific integration term for the adaptive feedforward term is already at the value it previously determined for that position. The adaptive feedforward term is precluded from having to recover from an integrator value corresponding to an actuator position not adjacent to the breakpoint corresponding to that actuator position, as is typical in a conventional integrator. These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF THE PREFERRED EMBODIMENT

The invention comprises a method and apparatus for controlling a device to a desired position. This includes characterizing the device, and determining an error term, based upon a monitored position of, and commanded input to the device. An adaptive feedforward term is determined, based upon the monitored position of the device, the characterization of the device, and the error term, and the device is controlled to the desired position, based upon the adaptive feedforward term and the error term. The adaptive feedforward term is determined, based upon the monitored position of the device, the characterization of the device, and the error term. This comprises determining a plurality of inputs, based upon the error term, integrating each of the plurality of inputs using a plurality of integrators with integration factors, and finally interpolating the integrations determined by integrating each of the plurality of inputs using a plurality of integrators with corresponding integration factors. The integration factors are based upon the characterization of the device. The characterization is regularly updated by adjusting the integration factors, based upon the integration factors and the error term.

Figure 1:
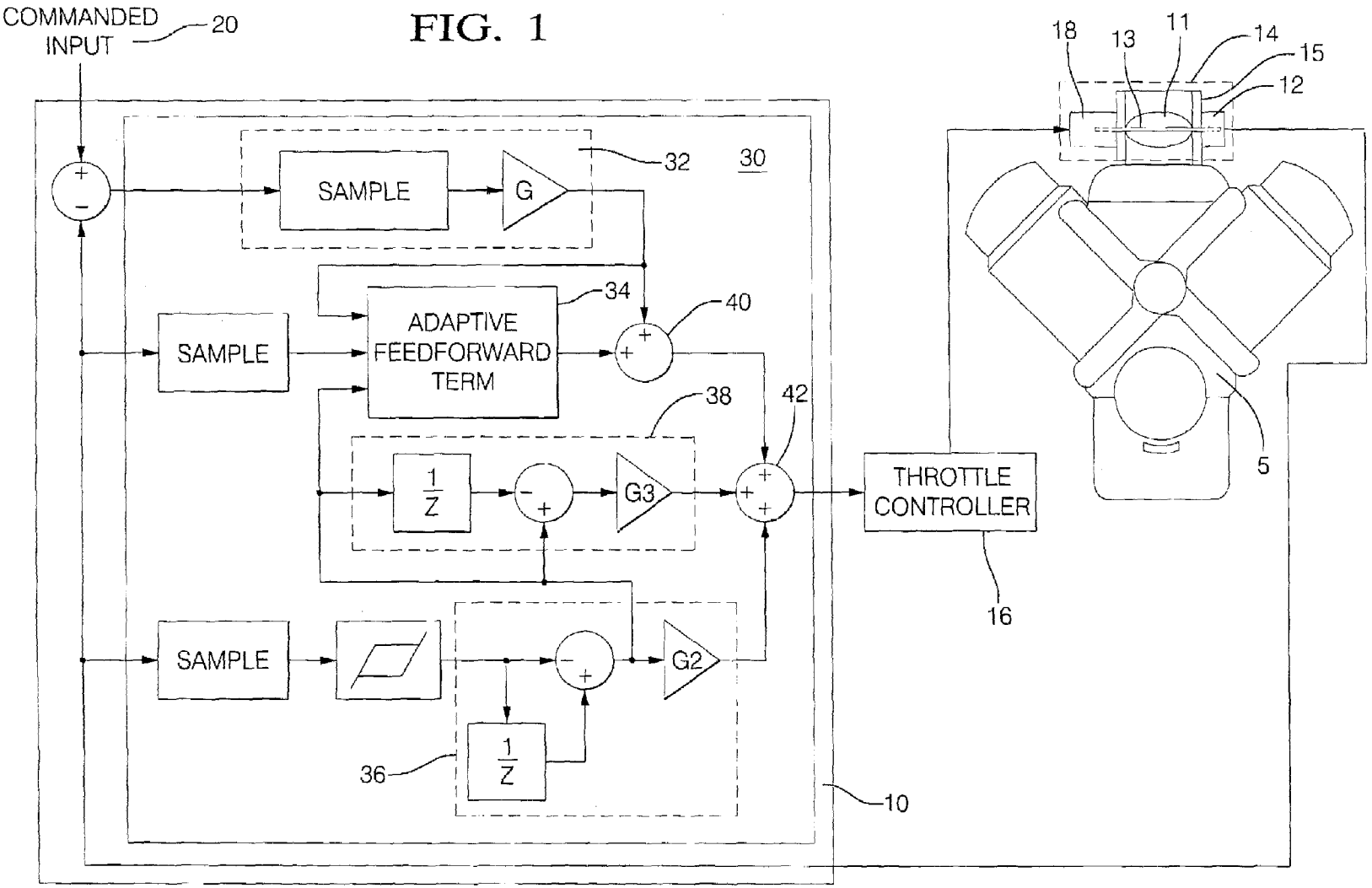
FIG. 1 is a schematic of an air management valve and control scheme for an internal combustion engine, in accordance with the present invention.

Referring now to the drawings, wherein the showings are for the purpose of illustrating an embodiment of the invention only and not for the purpose of limiting the same, FIG. 1 shows a schematic of a device and control scheme of the present invention. In this embodiment, the device is an air management valve 14 for an internal combustion engine 5 that is coupled with the control scheme, which has been constructed in accordance with an embodiment of the present invention. The engine 5 includes the air management valve comprising an electronic throttle control device 14 operable to control airflow into the engine in this embodiment. The electronic throttle control device 14 comprises a throttle blade 11 mounted on a rotating shaft 13, both situated in a throttle body 15. There is a predetermined relationship between rotational position of the throttle blade 11 and airflow into the engine 5 through the throttle body 15, and is further based upon pressure drop across the throttle blade 11. The rotating shaft 13 is operably attached to an actuator 18 and signally attached to a throttle position sensor 12. A controller 10 is preferably signally electrically attached to a throttle controller 16 that is operably attached to the actuator 18. The actuator 18 in this embodiment is preferably a commutated permanent-magnet DC motor with gear reduction, although the invention also encompasses other types of actuators, including for example, a torque motor. The throttle controller 16 converts a control output from the controller 10 to a power signal that is input to the actuator 18 to control rotation of the shaft 13. The control output is based upon a monitored input from the throttle position sensor 12 and a commanded input 20, such as from a pedal position sensor, as well as other parameters necessary for proper control and operation of the engine 5. The controller 10 controls airflow into the engine by controlling the rotational position of the throttle blade 13. Mechanization of air management valves, including electronic throttle control devices and controllers is known to one skilled in the art.

The controller 10 is preferably an electronic control module comprised of a central processing unit signally electrically connected to volatile and non-volatile memory devices via data buses. The controller 10 is operably attached to other sensing devices and output devices to monitor and control engine operation. The output devices preferably include subsystems necessary for proper control and operation of the engine 5, including a fuel injection system, a spark-ignition system (when a spark-ignition engine is used), an exhaust gas recirculation system, and an evaporative control system (not shown). The engine sensing devices include devices operable to monitor engine operation, external conditions, and operator demand, and are typically signally attached to the controller 10. The engine sensors preferably comprise an exhaust gas sensor, a crank sensor to measure engine speed and crank position, a manifold absolute pressure sensor to determine engine load, a mass air flow sensor, and others (not shown). The controller 10 controls operation of the engine 5 by collecting input from the sensors and controlling the output devices using control algorithms and calibrations internal to the controller 10 and using signals from the various sensors. The control algorithms are typically executed during preset loop cycles such that each control algorithm is executed at least once each loop cycle. Loop cycles are executed each 3, 6, 15, 25 and 100 milliseconds for typical engine operation. Use of the controller 10 to control the operation of the internal combustion engine 5 is well known to one skilled in the art.

The embodiment preferably includes input to the controller 10 comprising the commanded input 20 from an accelerator pedal position sensor (not shown). The controller 10 determines an operating point, based upon the engine sensing devices that are operable to monitor engine operation. The controller 10 determines a desired engine operating point, based upon the input from the accelerator pedal position sensor. The controller 10 then executes the control scheme to determine a desired position for the electronic throttle control device 14 based upon the operator demand for power, other engine operations, and the predetermined relationship between rotational position of the throttle blade 11 and airflow into the engine 5. The other engine operations include, for example, parasitic engine loads from an alternator (not shown), a transmission (not shown), and engine friction.

Referring again to FIG. 1, an embodiment of the control scheme 30 comprising a method and system for controlling the electronic throttle device 14 in accordance with the present invention is shown. The control scheme 30 is preferably executed during each 3-millisecond loop cycle in the controller 10 using internal control algorithms and calibrations. The control scheme 30 monitors the commanded input 20, typically in the form of an external input signal from the pedal position sensor (not shown) and the present position of the electronic throttle device 14 using input from the throttle position sensor 12. There is a characterization of the throttle device 14 contained in the control scheme 30. The control scheme 30 comprises a proportional block 32 operable to determine an error term, at least one derivative block 36, 38 operable to determine at least one derivative term, and an adaptive feedforward block 34 operable to determine an adaptive feedforward term. The characterization of the throttle device 14 is used to determine the adaptive feedforward term. The control scheme 30 determines the control output by combining the error term, the at least one derivative term, and the adaptive feedforward term, preferably by mathematically adding the terms, as shown in blocks 40 and 42. The control output, shown as the output of block 42, is provided to the throttle controller 16, which is operable to convert the control output to a power signal that controls the actuator 18 of the electronic throttle control device 14 to a desired position.

The control scheme 30 determines the error term in the proportional block 32 by calculating a difference between the monitored position of the throttle device and the commanded input 20 of the throttle device, and scaling the difference by a gain factor, G. The error term is expressed as a magnitude of the difference described hereinabove, and a mathematical sign, either positive or negative. The error term can also be zero. In this embodiment, the at least one derivative block comprises a first derivative block 36, and a second derivative block 38. The control scheme 30 determines a first derivative term in the first derivative block 36 which comprises a measure of time-rate of change in the monitored position of the throttle device, scaled by a gain factor G2. The first derivative term preferably comprises a difference in the monitored position of the throttle device, as measured during one loop cycle and an immediately subsequent loop cycle. The control scheme 30 determines a second derivative term in the second derivative block 38 which comprises a measure of the time-rate of change of the first derivative term 36, scaled by a gain factor G3. The second derivative term preferably comprises a difference in the first derivative term of the throttle device, as measured during one loop cycle and an immediately subsequent loop cycle. Determination of error terms and derivative terms are known to one skilled in the art.

Figure 2A:
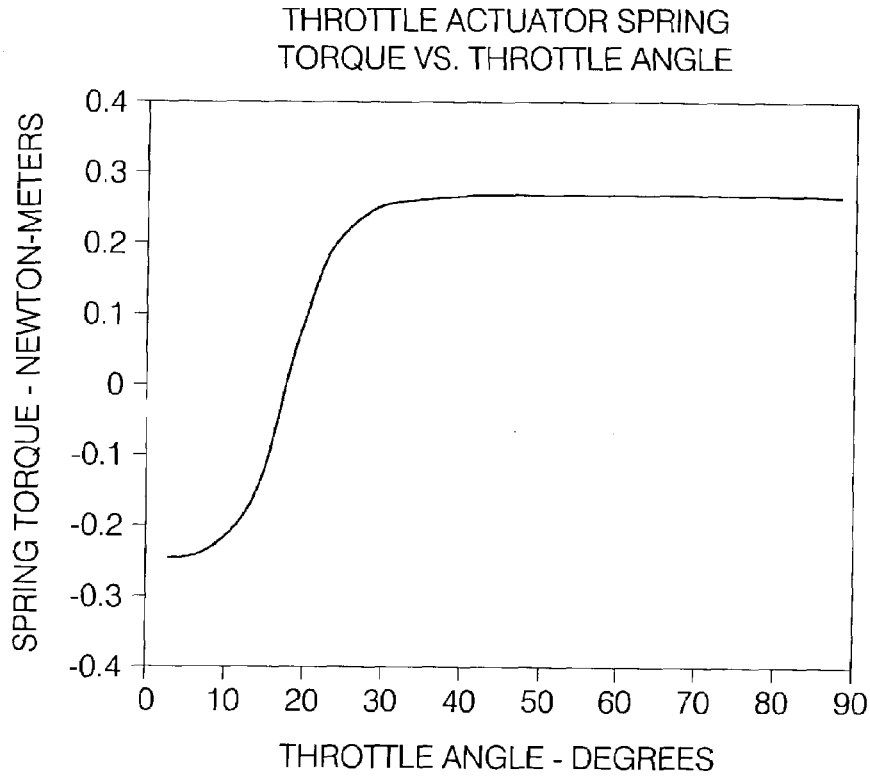
FIGS. 2A–2D comprise exemplary characteristic performance curves of an air management valve, in accordance with the present invention.
Figure 2B:
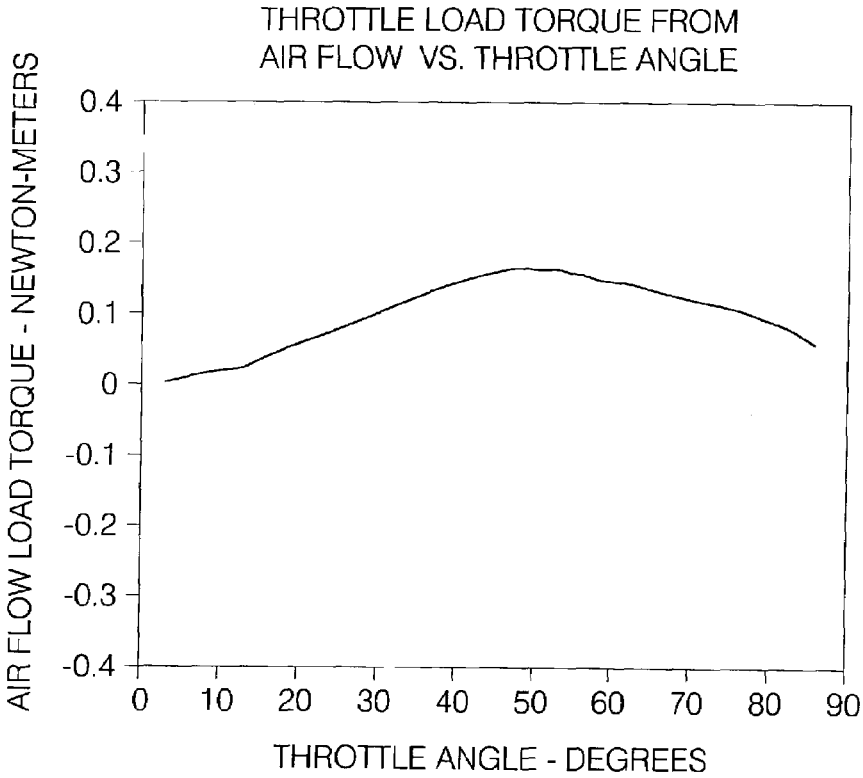
Figure 2C:
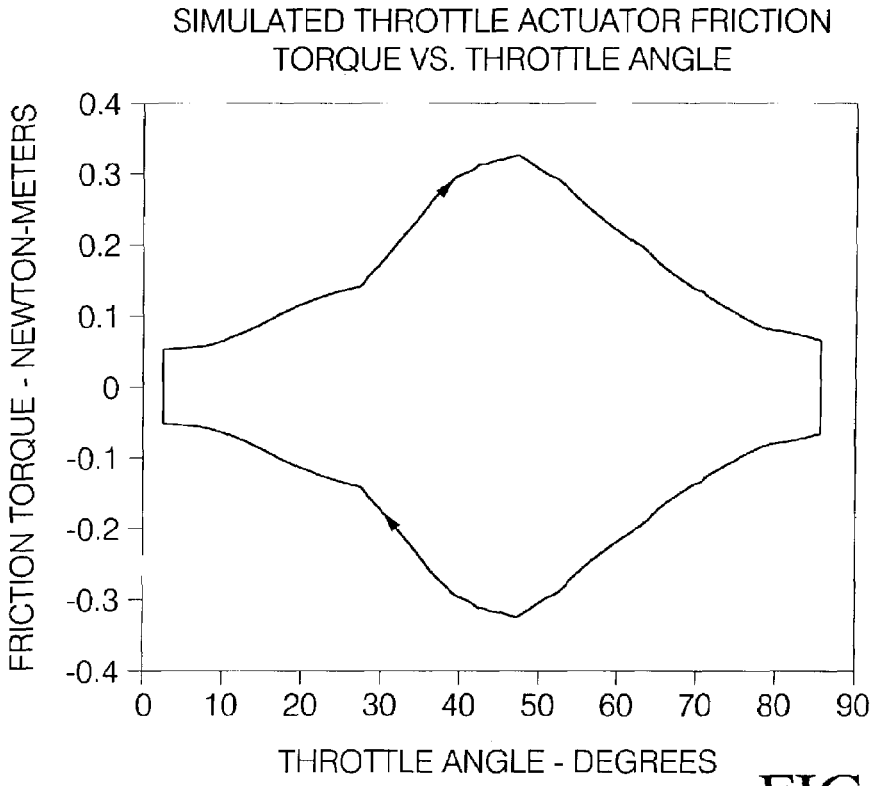
Figure 2D:
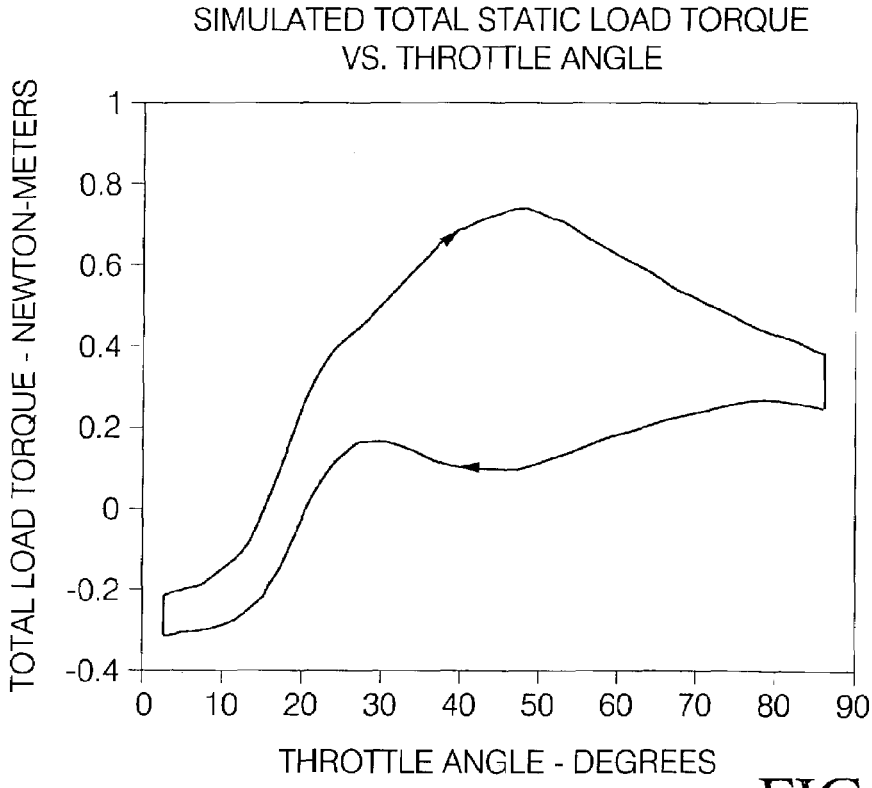

Referring now to FIGS. 2A–2D, characteristic curves of an exemplary electronic throttle control device 14, demonstrating the energization signal, in the form of a torque input necessary to overcome forces acting on the electronic throttle control device 14, are shown. An initial characterization of the electronic throttle control device 14 comprises the torque input from the actuator 18 necessary to adjust the throttle shaft 13 and throttle blade 11 to a specific position, under static conditions. FIG. 2A provides a measure of torque necessary to overcome torque from a return spring, over a range of throttle valve movement, as measured in degrees of throttle angle. FIG. 2B provides a measure of torque necessary to overcome air load torque originating in the intake manifold and any supercharger or turbocharger. FIG. 2C provides a measure of torque necessary to overcome friction torque in throttle bearings (not shown). This curve demonstrates that friction torque is dependent upon direction of movement of the electronic throttle control device 14, as the friction torque required to open the electronic throttle control device is substantially different from the friction torque required to close the electronic throttle control device. FIG. 2D provides a measure of the overall energization signal, in the form of torque, necessary to overcome torque on the electronic throttle control device 14 during static operation. The overall energization signal is the basis for initial characterization of the electronic throttle control device 14. Each of the aforementioned torque values is affected by component manufacturing tolerances and interferences, ambient conditions, component wear and cleanliness, and other conditions.

The control scheme 30 includes the initial characterization of the throttle device 14, which is typically determined during engine development, prior to regular production. The initial characterization is implemented as a plurality of initial integration factors, $I_i$ for a plurality of integrators (shown as 58, 60 in FIG. 3A) used by the adaptive feedforward term 34. When there is effectively zero friction in the throttle bearings, the plurality of initial integration factors, $I_i$, for the plurality of integrators will be same, regardless of whether the electronic throttle control device 14 is opening or closing. Therefore there is only a need for a single plurality of integrators. When there is significant friction in the throttle bearings (shown in FIG. 2C) the plurality of initial integration factors, $I_i$ for the plurality of integrators differs, depending upon whether the electronic throttle control device 14 is opening or closing. In the embodiment wherein there is significant friction in the throttle bearing, there is a first plurality of integrators 58 corresponding to when the electronic throttle control device 14 is opening, and a second plurality of integrators 60, corresponding to when the electronic throttle control device 14 is closing. The initial characterization is subsequently updated during ongoing engine operation, preferably when the absolute value of the first derivative term is below a predetermined value.

Figure 3A:
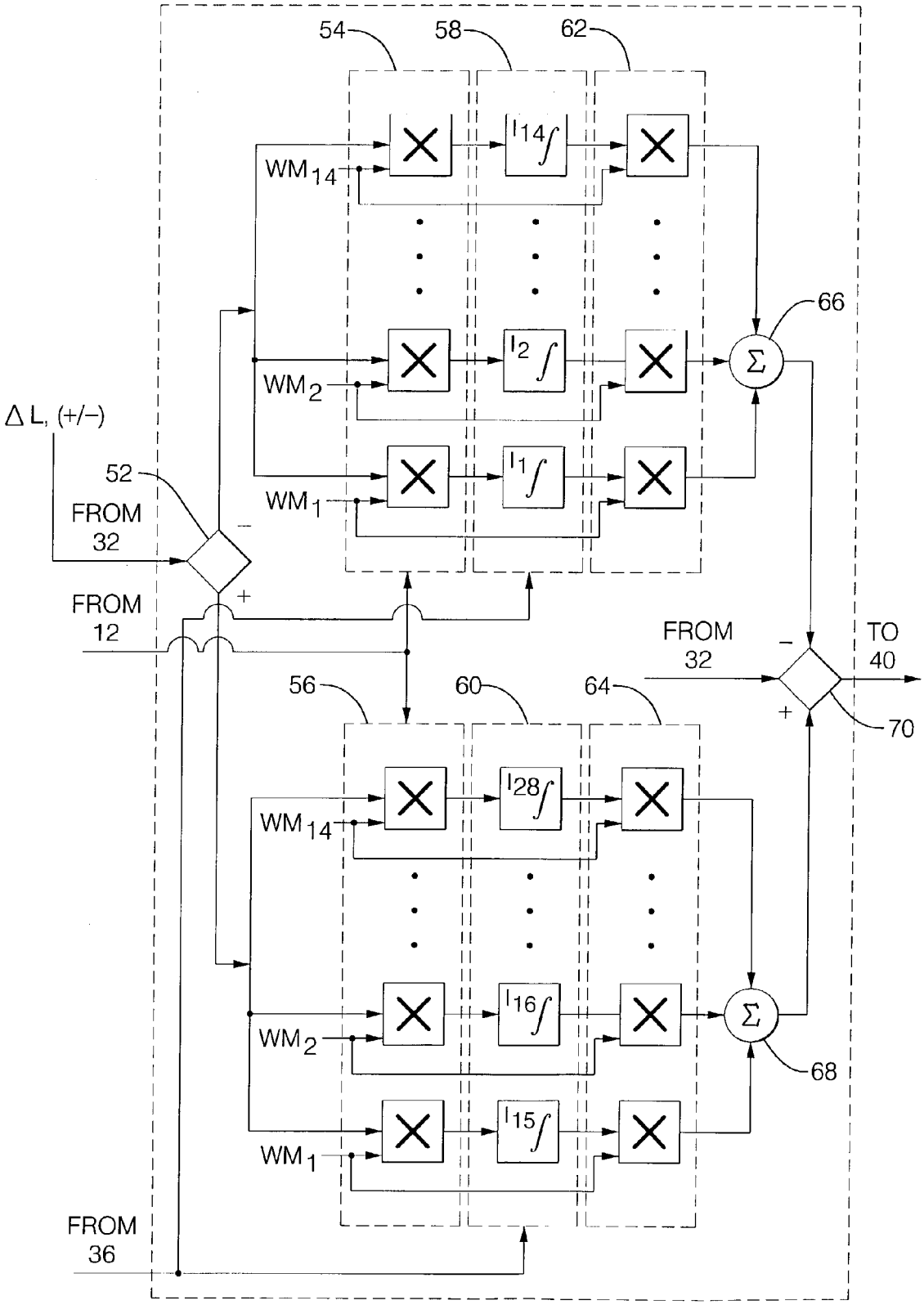
FIG. 3A is detailed schematic of the control scheme, in accordance with the present invention; and, FIG. 3B is a graphical representation of an element of the control scheme, in accordance with the present invention.

Referring now to FIG. 3A, the adaptive feedforward block 34 is shown in detail, wherein the adaptive feedforward term is determined as an output of the adaptive feedforward block 34, preferably using algorithms and calibrations contained in the controller 10. Inputs to the adaptive feedforward block 34 include the monitored position of the throttle device from the throttle position sensor 12, the error term from block 32, including both magnitude (ΔL) and mathematical sign (+/−) of the error term, and the first derivative term from block 36. The plurality of integrators comprises the first plurality of integrators 58 and the second plurality of integrators 60 in this embodiment. Each of the integrators of the first plurality of integrators 58 and the second plurality of integrators 60, has a corresponding initial integration factor ($I_1$ through $I_i$), wherein the values 1 through i designate a specific integrator within each plurality of integrators 58, 60. The integration factors ($I_1$ through $I_i$) for each of the first plurality 58 and the second plurality 60 of integrators preferably comprise the initial characterization of the throttle device 14 contained in the control scheme 30, as described previously. The initial integration factors ($I_1$ through $I_i$) for each of the integrators are preferably stored in the controller 10.

Referring again to FIG. 3A, the first plurality of integrators 58 and the second plurality of integrators 60 each comprise i=14 integrators, for a total of 28 integrators, each with an integration factor, $I_i$, in this embodiment. Each of the plurality of integrators corresponds to a magnitude of a specific monitored position of the throttle device 14, referred to as a breakpoint. The breakpoints in this embodiment are preferably set at throttle positions of 0°, 2°, 8°, 12°, 16°, 20°, 24°, 28°, 32°, 40°, 50°, 60°, 70°, 95° measured in degrees of rotation from a fully closed throttle position. Referring to block 58 in this embodiment, integrator 1 corresponds to a throttle position of 0° with an initial integration factor of $I_1$, integrator 2 corresponds to a throttle position of 2° with an initial integration factor of $I_2$, on through integrator 14 which corresponds to a throttle position of 95° with an initial integration factor of $I_{14}$. Referring to block 60 in this embodiment, integrator 15 corresponds to a throttle position of 0° with an initial integration factor of $I_{15}$, integrator 16 corresponds to a throttle position of 2° with an initial integration factor of $I_{16}$, on through integrator 28 which corresponds to a throttle position of 95° with an initial integration factor of $I_{28}$. The selection of the quantity of integrators and corresponding breakpoints is a design decision chosen during system development. The quantity of 2 sets of 14 integrators is exemplary of this specific embodiment, and is not meant to be restrictive.

In operation, the control scheme 30 selects the first plurality of integrators 58 when the mathematical sign of the error term 32 is negative, indicating that the throttle blade 13 is opening, thus increasing airflow into the engine 5, as shown in block 52. The control scheme 30 selects the second plurality of integrators 60 when the mathematical sign of the error term 32 is positive, indicating that the throttle blade 13 is closing, thus decreasing airflow into the engine 5, again as shown in block 52. The magnitude of the monitored throttle position, as input from the throttle position sensor 12, determines which individual integrator, or pair of integrators, from the first or second plurality of integrators (58 or 60) is used for signal processing to determine the adaptive feedforward term. The specific integrators are chosen using weight multipliers $WM_1$ through $WM_i$, which correspond to integrators 1 through i, wherein i=14 in this embodiment. Determination of the weight multipliers is further described in reference to FIG. 3B.

When the mathematical sign of the error term 32 is negative, the first plurality of integrators 58 is selected, as shown by block 52. The magnitude of the error term, ΔL, is scaled in proportion to the position of the monitored position relative to position of adjacent breakpoints (block 54). Each of the scaled error terms are input to a corresponding one of the first plurality of integrators 58, and the outputs of each of the first plurality of integrators 58 are interpolated. The scaled error terms are determined by multiplying the error term by each of the weight multipliers $WM_1$ through $WM_{14}$, as shown in block 54 (and designated as $WM_i$*ΔL). Each of the scaled error terms is integrated through the corresponding integrators having the integration factors $I_1$ through $I_{14}$, as shown in block 58. The adaptive feedforward term is determined by interpolating the outputs of each of the integrators of block 58. Interpolation comprises multiplying the outputs of each of the integrators by the corresponding weight multiplier $WM_1$ through $WM_{14}$, as shown in block 62, and then mathematically adding the results from block 62 (see block 66) to provide input to block 70.

When the mathematical sign of the error term 32 is positive, the second plurality of integrators 60 is selected, as shown by block 52. The magnitude of the error term ΔL is scaled in proportion to the position of the monitored position, relative to position of adjacent breakpoints (see block 56). Each of the scaled error terms are input to a corresponding one of the second plurality of integrators 60, and the outputs of each of the second plurality of integrators 60 are interpolated. The scaled error terms are determined by multiplying the error term by each of the weight multipliers $WM_1$ through $WM_{14}$, as shown in block 56, again designated as $WM_i$*ΔL. Each of the scaled error terms is integrated through the corresponding integrators having the integration factors $I_{15}$ through $I_{28}$, as shown in block 60. The adaptive feedforward term is determined by interpolating the outputs of each of the integrators of block 64. Interpolation comprises multiplying the outputs of each of the integrators by the corresponding weight multiplier $WM_1$ through $WM_{14}$, as shown in block 64, and then mathematically adding the results from block 64 (see block 68) to provide input to block 70.

The adaptive feedforward term that is output from block 34 is determined in block 70, based upon input from the error term 32. When the mathematical sign of the error term 32 is negative, the output from block 66 is selected as the adaptive feedforward term that is used by the control scheme 30, and is the output from block 34 to block 70. When the mathematical sign of the error term 32 is positive, the output from block 68 is selected as the adaptive feedforward term that is used by the control scheme 30, and is the output from block 34 to block 70.

Figure 3B:
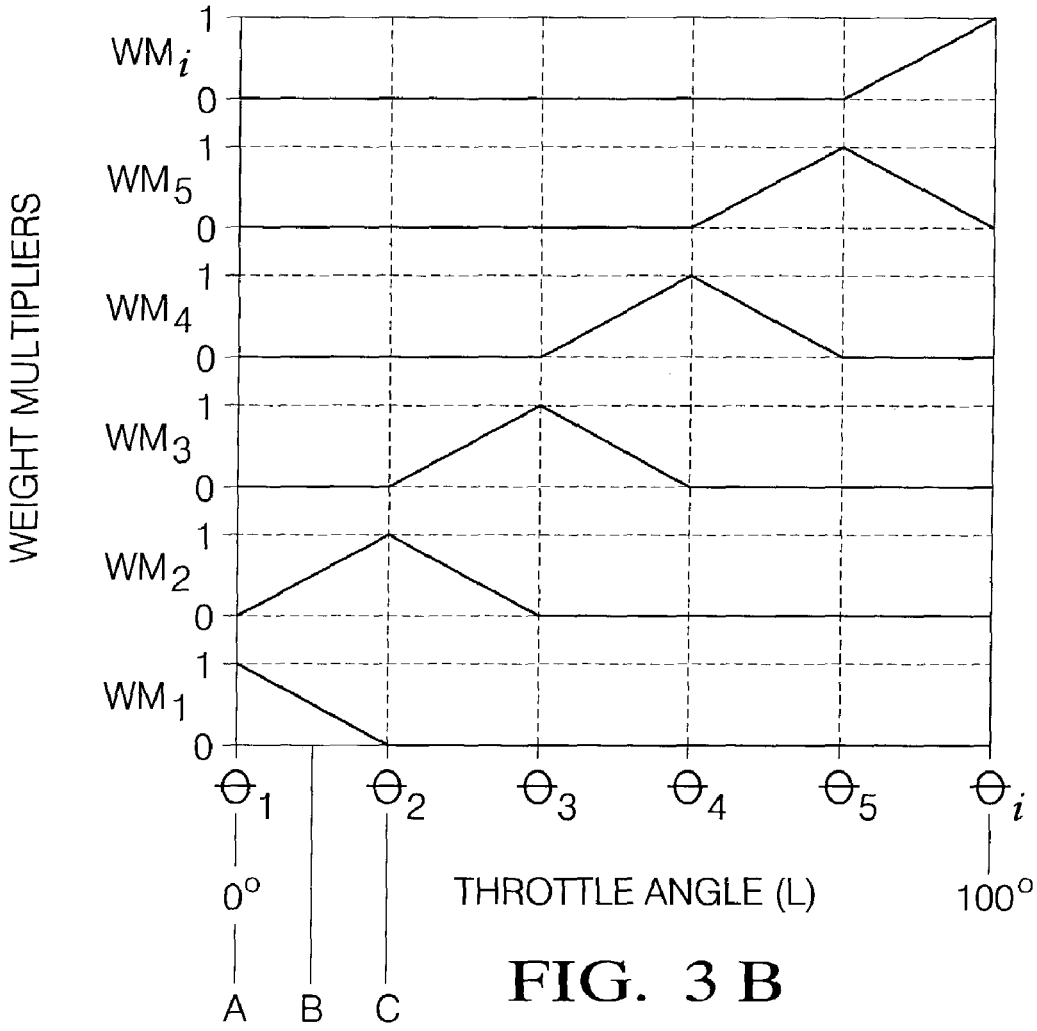

Referring now to FIG. 3B, a graphical representation of weight multipliers $WM_1$ through $WM_{14}$, is shown to further describe an embodiment of how a single integrator, or a pair of integrators is chosen by the control scheme 30. The purpose of the use of weighted multipliers is to effect interpolation between adjacent breakpoints. A horizontal axis depicts the throttle position, over a range from 0° to 95°, designated with specific breakpoints, which are set at throttle positions of 0°, 2°, 8°, 12°, 16°, 20°, 24°, 28°, 32°, 40°, 50°, 60°, 70°, 95° for this embodiment. A vertical axis depicts a series of scales, wherein each scale has a scalar value ranging from 0.0 to 1.0, and each scale represents a weighted multiplier $WM_1$ through $WM_{14}$. A line is shown for each of the scales that depicts the scalar value of the corresponding weighted multiplier as a function of throttle position. By way of example, in this embodiment when throttle position is 0° (see point A), weight multiplier $WM_1$=1.0, and $WM_2$ through $WM_{14}$ are each 0.0; when throttle position is 1° (see point B), weight multiplier $WM_1$=0.5, $WM_2$=0.5, and $WM_3$ through $WM_{14}$ are each 0.0; and when throttle position is 2° (see point C), weight multiplier $WM_1$=0.0, $WM_2$=1.0, and $WM_3$ through $WM_{14}$ are each 0.0. This graphical representation is preferably implemented in the controller 10 using an algorithm operable to calculate a scalar value for each of the weight multipliers $WM_1$ through $WM_{14}$ based upon the throttle position.

Referring again to FIG. 3A, when the absolute value of the first derivative term, output from block 36, is below a predetermined value, the adaptive feedforward block 34 is operable to update the integration factors $I_i$ for at least one of the integrators. The integrators to be updated are selected from the first plurality of integrators 58 or the second plurality of integrators 60. The control scheme 30 selects the specific integrators that are being applied in the adaptive feedforward block 34, based upon whether the corresponding weight multipliers $WM_i$ have a value greater than zero. Each of the integration factors $I_i$ of the selected specific integrators are adjusted by a value equal to the integration factor $I_i$ multiplied by the error term from block 32 and multiplied by the corresponding weight multiplier $WM_i$. This calculation is made during each loop cycle. The adjustment of the integration factors occurs during subsequent loop cycles while the absolute value of the first derivative term remains below the predetermined value. The adjusted integration factors $I_i$ are stored for use by the adaptive feedforward block 34 during ongoing operation. The integration factors $I_i$ for each of the integrators are also preferably stored for use by the controller during subsequent engine operation, after an engine-off event. Alternatively, the controller may erase each of the gain factors at engine shutdown, and rely upon the initial characterization at the next engine start event.

When the integration factors for the selected specific integrators from the selected plurality of integrators are updated as described previously, the integration factors for corresponding selected specific integrators from the unselected plurality of integrators are also updated, but at a different rate that is preferably slower. Each of the integration factors $I_i$ of the selected specific integrators (from the unselected plurality of integrators) are adjusted by a value equal to the integration factor $I_i$ multiplied by the corresponding weight multiplier $WM_i$, which is then multiplied by a scalar value that is typically much less than one. Adjustment of the integration factors $I_i$ of the selected specific integrators from the unselected plurality of integrators is limited so that the values do not exceed the values of the integration factors $I_i$ of the corresponding selected specific integrators from the selected plurality of integrators. This calculation is also made during each loop cycle. The adjusted integration factors $I_i$ are also stored for use by the adaptive feedforward block 34 during ongoing operation.

The invention comprises a method and control scheme for controlling a device to a desired position. Although this embodiment of the invention is described as a method and control scheme for an air management valve on an internal combustion engine, it is understood that alternate embodiments of this invention can include other devices that are controlled to a desired position. This includes air management valves on engines such as manifold vacuum regulator valves (MVRV), and other airflow control valves. The invention also envisions position control of all rotary valves, linear valves, linkages, slides, cranks, and other control system devices using electrical, mechanical, pneumatic and hydraulic actuators. Thus, it is envisioned that the method and control scheme is applicable to systems using devices wherein timely, accurate control of position is important, and wherein control may be affected by direction of movement of the valve. It is also understood that the used of weighted multipliers to interpolate between breakpoints is a specific embodiment, and that there are other methods of interpolating between breakpoints that may be implemented, including hardware solutions and other algorithm solutions. The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A system to control an air management valve, comprising:

said air management valve, including at least one feedback sensor, and, an actuator;

a sensor operable to determine a commanded input; and, a control scheme, operable to:

monitor a position of the air management valve using the input from the feedback sensor, determine an error term, based upon the monitored position of the air management valve and the commanded input, and, determine an adaptive feedforward term, based upon the monitored position of the air management valve, a characterization of the air management valve, and the error term, wherein the characterization of the air management valve is based upon torque and a direction of movement of the air management valve; and control the air management valve to a desired position, based upon input from the feedback sensor, the adaptive feedforward term, and the sensor operable to determine the commanded input.

2. The system of claim 1, comprising:

a controller, operably connected to the actuator, signally electrically connected to the at least one feedback sensor, signally electrically connected to the sensor operable to determine the commanded input, and, operable to execute the control scheme using algorithms and calibrations;

wherein the controller executes the control scheme to control the actuator, based upon the at least one feedback sensor and the sensor operable to determine the commanded input.

3. The system of claim 1, further comprising the air management valve on an internal combustion engine.

4. The system of claim 1, wherein the characterization of the air management valve is based upon torque of a return spring, air load torque, or friction torque.

5. The system of claim 3, wherein the air management valve comprises an electronic throttle control device with a torque motor.

6. The system of claim 3, wherein the air management valve comprises an electronic throttle control device with a permanent-magnet DC motor.

7. The system of claim 3, wherein the air management valve comprises a manifold vacuum regulator valve with an electric motor.

8. The system of claim 1, wherein the sensor operable to determine the commanded input comprises a pedal position sensor.

* * * * *